United States Patent [19]

Klemm

[11] 4,134,460

[45] Jan. 16, 1979

[54] HYDRAULIC DRILLING DEVICE

[75] Inventor: Günter Klemm, Wenkhausen, Fed. Rep. of Germany

[73] Assignee: Firm. Ing. Günter Klemm, Drolshagen, Fed. Rep. of Germany

[21] Appl. No.: 796,303

[22] Filed: May 12, 1977

[30] Foreign Application Priority Data

May 15, 1976 [DE] Fed. Rep. of Germany ..... 2621755

[51] Int. Cl.[2] ..... E21B 3/00

[52] U.S. Cl. ..... 173/163; 173/104

[58] Field of Search ..... 173/163, 164, 104, 105

[56] References Cited

U.S. PATENT DOCUMENTS

| | | | |
|---|---|---|---|
| 3,103,676 | 9/1963 | Kehaly | 173/163 |
| 3,166,131 | 1/1965 | Worman | 173/105 |
| 3,472,323 | 10/1969 | Hall | 173/163 |
| 3,701,386 | 10/1972 | Feucht | 173/105 |
| 3,752,241 | 8/1973 | Bent | 173/163 |
| 3,858,666 | 1/1975 | Bailey et al. | 173/105 |

*Primary Examiner*—Robert A. Hafer

*Attorney, Agent, or Firm*—Spensley, Horn, Jubas & Lubitz

[57] ABSTRACT

This drilling device includes a hydraulic motor, coaxially surrounding the drill rod, for rotating the drill. The rotor of the motor directly rotates the drill, without the use of gears. Advantageously, the rotor includes a replaceable adapter sleeve that has a shape conforming to the peripheral shape of the drill. By replacing the sleeve, drill rods of different shape or size can be accommodated. The rotor may be of the wing cell type, wherein a plurality of radially moveable vanes or wings project radially from a circular rotor into contact with the inner wall of a non-circular cylinder wall. The vanes define cells within which the hydraulic fluid presses against the vanes so as to impart rotation to the rotor, sleeve and drill.

2 Claims, 2 Drawing Figures

HYDRAULIC DRILLING DEVICE

BACKGROUND OF THE INVENTION

1. Field of the Invention

The invention relates to a hydraulic drilling device comprising a driving head mountable at the upper end of a drill rod, a hydraulic motor for rotating the drill being fitted coaxially about the driving head.

2. Description of the Prior Art

In known drill hammers, the hydraulic motor is secured laterally to the drive head and drives the drill rod via a pinion fastened to the motor shaft and a crown gear connected to rotate the drill. With such a drive means, because of the crown gear, pinion and lateral motor arrangement, the drive head has a substantial radial projection, which makes its use in mining inconvenient. As known, it is necessary in mining to work in narrow tunnels and, to advance a shaft or gallery, the bore holes should be as close as possible to the gallery wall. The greater the radial dimension of the drill head, the more difficult is it to drill a bore hole directly adjacent to the gallery wall. Therefore, the holes are frequently bored at an inclination relative to the gallery axis. Moreover, the weight of the pinion and crown gear assembly significantly increases the weight of the drill hammer.

It is an object of the invention to provide a drilling device of the type described, wherein the radial extension of the drill rotation means is relatively small, which is of lighter weight than known drilling hammers, which does not require a crown gear assembly, and which can be manufactured simply and at low cost.

SUMMARY OF THE INVENTION

These and other objectives are achieved by the invention, wherein the hydraulic motor is mounted coaxially relative to the drill, with its rotor directly connected to rotate the drill without gearing.

By means of the unitary rotational connection between the rotor of the hydraulic motor and the drill, the additional weight of a drive transmission having gears is eliminated, and the overall radial dimension of the complete drill head assembly is reduced to the motor dimension itself. Thus the drilling head has the smallest radial size, enabling it to be manipulated much better than known drilling hammers. Hydraulic motors suitable for use in the drilling hammer of the invention include rotary piston motors or turbine-like drives. For example, a wing cell motor, also called a rotating piston fluid engine, is useful. Alternatively, it is also possible to use a gear type motor, the rotor of which consists of a helical gear, the oil pressure acting against its teeth in a direction parallel to the drill axis so that a power component is produced in the peripheral, drill-rotating direction. The hydraulic liquid used by the coaxial motor is present in very close proximity to the drill rod, adjacent the end which is struck by the hammer. As a result, the hydraulic motor drive fluid carries off heat generated at the hammer by friction and impact energy, thereby cooling the drilling hammer without the need for a special cooling assembly near the impact zone.

To adapt the drill head to drill rods of different size, there is provided in another embodiment of the invention, a replaceable sleeve which fits in a bore through the rotor so as to rotate therewith, and which has an inner profile that conforms to the outer profile and dimensions of the drill rod. To use a drill having other dimensions, it is merely necessary to insert into the rotor another sleeve which has an inner profile and size corresponding to the new drill.

Preferably, the hydraulic lines to the drill-rotating motor are conducted out of the motor casing in parallel to the motor axis. In known wing cell motors, the hydraulic lines are connected to the motor casing substantially radially. In accordance with the invention, the connections are made parallel to the axis so as to reduce the radial dimensions and to improve the utility of the drilling device. The hydraulic lines may be fitted to the rear wall of the motor.

To prevent a drill from being unintentionally released from the drill head, a blocking device which engages a flange on the drill may be provided at the outer front wall of the motor, facing the drill.

The penetration of dust or liquid along the drill rod into the drill head may impair the operability of the motor and the drill hammer. Such penetration is prevented by an elastic cap that can be inserted into an annular groove on the drill. The skirt of the cap at least partly covers the outer front wall of the motor casing. The cap rotates with the drill. It is particularly useful where drilling is done in a vertically upward direction. Material which drops onto the rotating cap is immediately centrifuged away from the drill mechanism.

BRIEF DESCRIPTION OF THE DRAWINGS

A working example of the invention is described below with reference to the drawing, wherein.

DESCRIPTION OF THE PREFERRED EMBODIMENT

Figure 1:
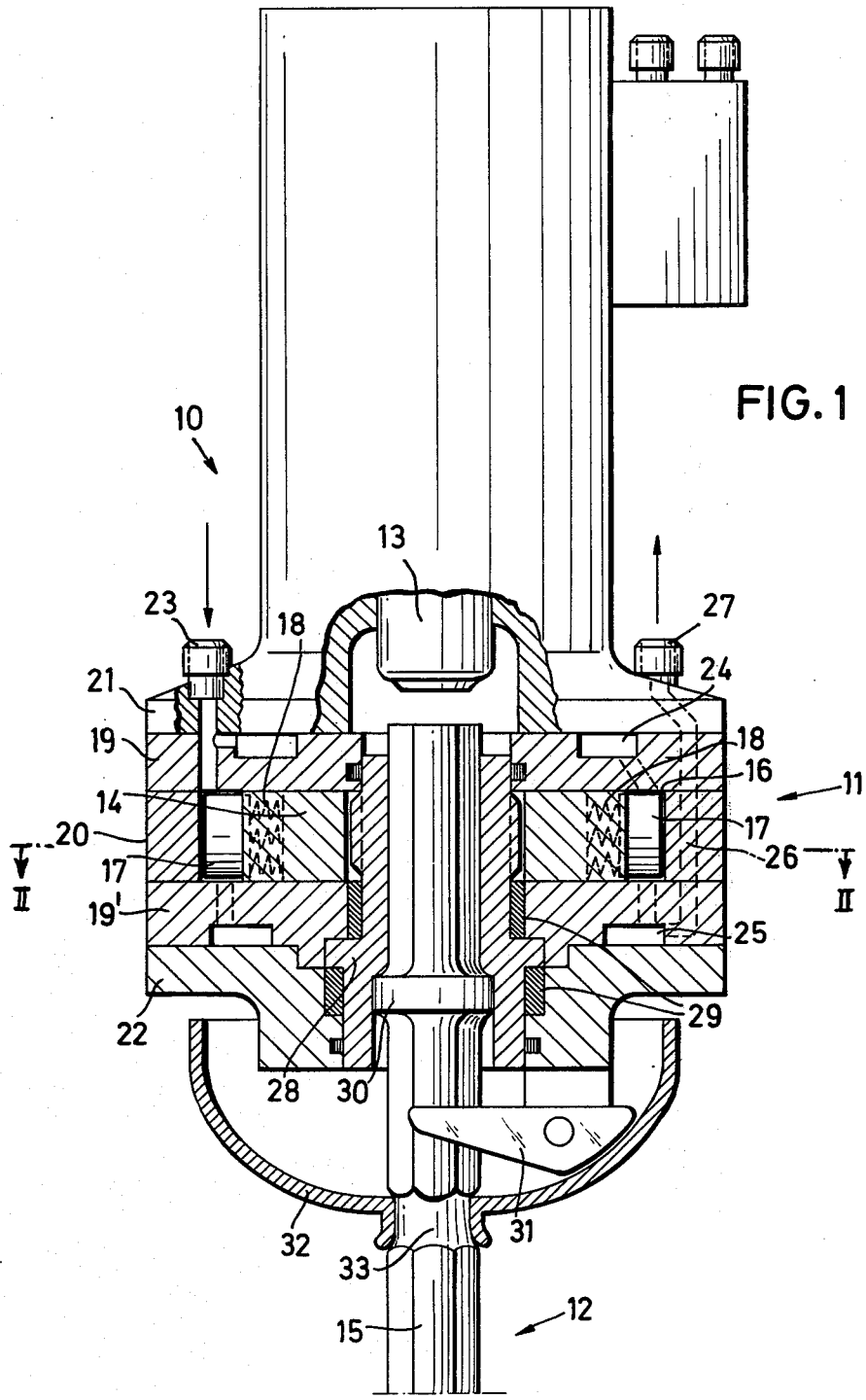
FIG. 1 shows a lateral view of a drill hammer of the invention, partly cut away and in section.
Figure 2:
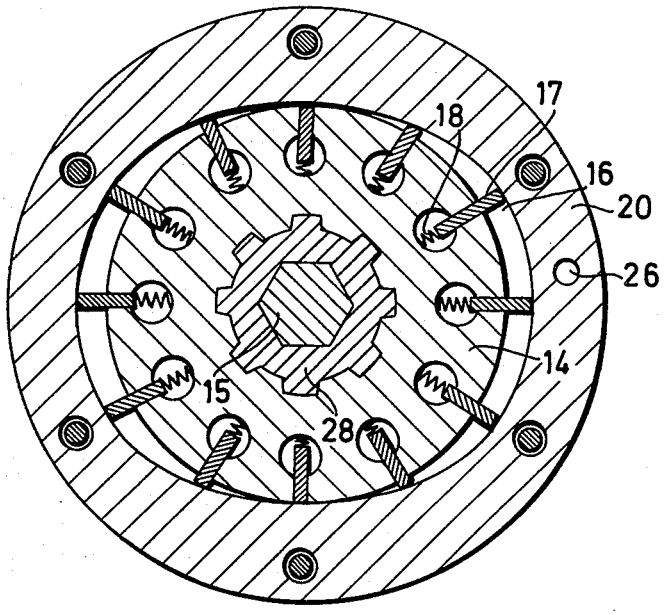
FIG. 2 shows a section along line II—II of FIG. 1 through the hydraulic motor.

The illustrated drill hammer consists of a hydraulic hammer 10 having a working piston 13 which axially strikes the drill rod 12, and a hydraulic motor 11 which rotates the drill 12 about its axis. The end 15 of the drill 12 projects through the rotor 14 of the hydraulic motor and acts as an anvil for the piston 13.

The hydraulic motor 11 advantageously is a wing cell motor. The working chamber 16 in which rotor 14 rotates is substantially elliptical, the smaller elliptical axis corresponding in size to the rotor 14 diameter. The rotor 14 has several vanes or wings 17 arranged about its periphery and projecting radially from within the cylinder wall of the rotor 14. Springs 18 urge the vanes 17 radially outwardly. The vanes 17 together with the inner wall of the stator ring 20 and with the cylinder wall of the rotor 14 define the individual working chambers.

The stator consists of the two face plates 19, 19' and the ring 20 which is sandwiched between them. The ring 20 forms the radial outer wall of the elliptic cylinder space 16. It is firmly clamped between the face plates 19 and 19'. Outer walls 21, 22 for the motor 11 are provided on the other side of the face plates 19, 19'. The parts 19, 19', 20, 21 and 22 are firmly clamped together by bolts. The rear wall 21 is an integral part of the casing of the hydraulic hammer 10.

The hydraulic liquid under pressure flows via a connection 23, through the rear wall 21 and into the face plate 19. The plate 19 has an annular channel 24 from which the hydraulic fulid is directed into the cylinder space 16 via a plurality of individual bores. The face plate 19' also has an annular channel 25 which receives fluid from the cylinder space 16 via another set of individual bores. The two annular channels 24 and 25 are radially offset. The annular channel 25 is connected to the return line fitting 27 via a conduit 26.

The periphery of the motor 11 being greater than that of the hydraulic hammer 10, the fittings 23 and 27 may be arranged so that the hydraulic fluid flow lines extend parallel to the axis of the hammer 10, along at the portion of the rear wall 21 that forms the casing of the hydraulic hammer 10.

The rotor 14 has a through bore with splined shaft profile. A sleeve 28, having a like splined shaft profile, is inserted into the rotor bore so that the sleeve 28 rotates in unison with the rotor 14. In parts 19 and 22, the sleeve 28 is supported by slide bearings 29.

The sleeve 28 has an internal hexagonal profile or other multiple-cornered profile corresponding to the multi-cornered profile of the uppermost end of the drill 12. This permits the drill 12 to be inserted into the sleeve 28 so as to be rotated in unison therewith. The drill 12 has a flange 30 near its upper end which abuts against a shoulder of the sleeve 28. The end of the drill 12 protrudes through and beyond the sleeve 28 so that is can be struck by the working piston 13 of the hydraulic hammer 10.

The front wall 22 of the motor 11 has a hub-shaped projection to which is attached a blocking device 31. The device 31 consists of a swivable lever which underengages the flange 30 so that the drill 12 cannot be removed from the sleeve 28 when the lever is swivelled to the position shown in FIG. 1.

To prevent the penetration of dust or drilling mud into the motor 11, there is provided a flexible protective cap 32 made of rubber, plastic or other rigid material. The cap 32 is fitted to the drill rod 12 and partly covers the hub-shaped projection of the front wall 22. The bell-shaped protective cap 32 engages an annular groove 33 on the drill rod end 15 so as to rotate therewith. Mud dropping onto the rotating protective cap 32 will be centrifically cast off.

The hydraulic motor 11 has for instance a speed of 100 to 400 r.p.m. In the drawing, the motor 11 is only shown schematically, the different seals being omitted for reasons of clarity.

What is claimed is:

1. A hydraulic drilling device of the type having a drill hammer with an impact piston for striking the end of a drill to impart axial motion thereto, and having a hydraulic motor for rotating the drill, said motor coaxially surrounding the drill and comprising:

a motor housing mounted coaxially at the forward end of said drill hammer, the outside diameter of said housing being greater than the diameter of said drill hammer, said housing including a stator ring sandwiched between a pair of face plates, said stator ring having an elliptic interior shape which defines the wall of a cylinder space, a circular rotor situated within said stator ring coaxial with said drill, said rotor having a diameter conforming to the minor axis of said stator ring elliptic shape, said rotor having a plurality of radially extending vanes, each vane being movable radially and spring biased into contact with said cylinder space wall, said rotor having a coaxial bore therethrough, said bore having a non-circular geometric shape, flow channel means in said face plates for directing the flow of hydraulic fluid through said cylinder space so as to exert force on said vanes and rotate said rotor, said means comprising:

a hydraulic fluid inlet fitting and a hydraulic fluid outlet fitting extending from the annular rear wall of said motor housing so as to facilitate connection to hydraulic fluid flow lines extending parallel to the axis of said drill hammer at a radius less than that of said housing periphery, a first annular channel within one of said face plates and a second annular channel within the other of said face plates, said annular channels having different radii, each channel communicating to a respective one of said hydraulic fluid fittings and communicating to said cylinder space via a respective set of bores in the respective face plates, hydraulic fluid entering said inlet fitting flowing through one of said channels and the associated set of bores into said cylinder space where it exerts force on said vanes to rotate said rotor, said fluid exiting via the other set of bores, the other channel and said outlet fitting, and a replaceable adapter sleeve situated within and having the same exterior shape as said rotor bore, the interior of said sleeve being configured like the cross-section of said drill, said drill being received within said sleeve so that said rotor, sleeve and drill rotate in unison under pressure of said hydraulic fluid on said vanes, drills of different size or cross-sectional configuration being accommodated by separate replaceable adapter sleeves having the same exterior shape but each having an interior shape configured like the respective drill cross-section, said drill being free to move axially with respect to said adapter sleeve under impact from said piston.

2. A hydraulic drilling device for mining and like applications, said device having a drive head mountable at the upper end of a drill rod, the head being provided with an impact piston for striking the end of said drill rod to impart axial motion thereto, and with a hydraulic motor for rotating the drill, characterized in that the hydraulic motor is fitted coaxially relative to the drill, and that the rotor of said hydraulic motor is connected directly to rotate the drill, said motor being a wing cell motor with a non-circular working chamber, said rotor being fitted with radially extending vanes mounted for radial movement and biased to maintain contact with the inner wall of said working chamber as said rotor is rotating, a sleeve being fitted in a through bore of the rotor so as to rotate in unison therewith, said sleeve having an internal profile that conforms to the outer profile of the drill, the hydraulic connecting lines to the hydraulic motor being conducted out of the motor casing in parallel to the motor axis, a blocking device being provided at the outer front wall of the motor, said device underengaging a flange of the drill so as to retain the drill within said drive head, and a cap being provided at the drill, which cap at least partly covers the outer front wall of the motor casing and which rotates with said drill.

* * * * *